US005549176A

United States Patent [19]

Hawkins

[11] Patent Number: 5,549,176

[45] Date of Patent: Aug. 27, 1996

[54] BRIDGE CONSTRUCTION MACHINERY AND METHOD FOR CONSTRUCTING BRIDGES

[75] Inventor: Claude D. Hawkins, Cantonment, Fla.

[73] Assignee: Modern Bridge Forming Co., Inc., Cantonment, Fla.

[21] Appl. No.: 303,347

[22] Filed: Sep. 9, 1994

[51] Int. Cl.[6] ..... G04G 3/00

[52] U.S. Cl. ..... 182/63; 182/150

[58] Field of Search ..... 182/63, 150; 14/77.1

[56] References Cited

U.S. PATENT DOCUMENTS

| | | | |
|---|---|---|---|
| 2,639,950 | 5/1953 | Wheeler . | |
| 2,669,490 | 2/1954 | Kaufman . | |
| 3,456,746 | 7/1969 | Price . | |
| 3,550,723 | 12/1970 | Gentry . | |
| 3,571,835 | 3/1971 | Buechler . | |
| 3,608,669 | 9/1971 | Lindsay, Jr. . | |
| 3,985,480 | 1/1976 | Finsterwalder . | |
| 4,103,861 | 8/1978 | Büchler et al. . | |
| 4,260,126 | 4/1981 | Schreck et al. . | |
| 4,556,124 | 12/1985 | Lotto . | |
| 4,633,975 | 1/1987 | Connor et al. . | |
| 4,660,680 | 4/1987 | Potin | 182/63 X |
| 4,690,247 | 9/1987 | Yoshida . | |
| 4,696,371 | 9/1987 | Moog . | |
| 4,873,738 | 10/1989 | Shook et al. . | |
| 4,877,365 | 10/1989 | Lanigan, Jr. et al. . | |
| 5,318,149 | 6/1994 | Moog | 182/63 |

*Primary Examiner*—Alvin C. Chin-Shue
*Attorney, Agent, or Firm*—Darby & Darby, P.C.

[57] ABSTRACT

Apparatus for removing forms from the girders of a bridge, including a frame structure, a carriage which is movable below the bridge girders, and a carriage support which is attached to the frame structure and which supports the carriage. The carriage is movable between two pivotal support arms which are pivotal between a stowed position and an operative position. The carriage is supported out from under the bridge when the support arms are in the stowed position. The entire apparatus may be easily manipulated to avoid contact with any portion of the bridge, in particular, the vertical pilings, as the apparatus moves along the length of the bridge.

15 Claims, 16 Drawing Sheets

FIG. 11
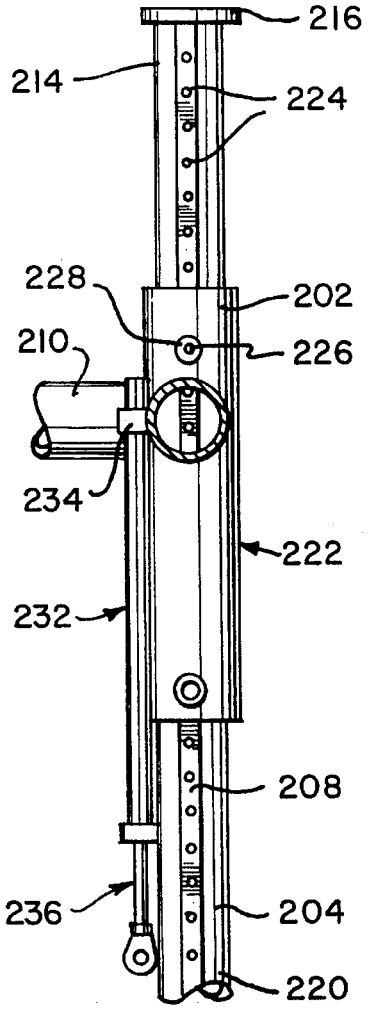
FIG. 14
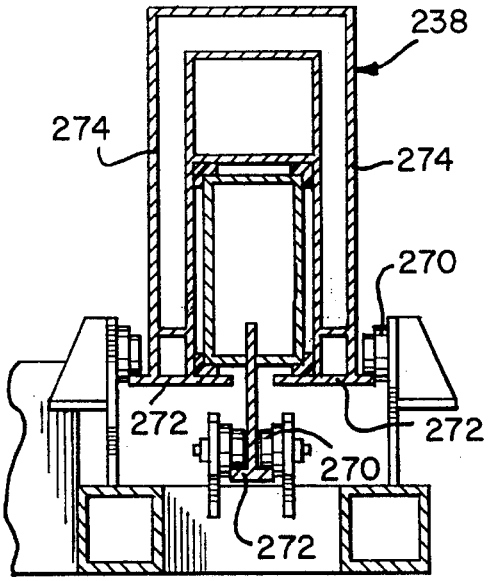
FIG. 6
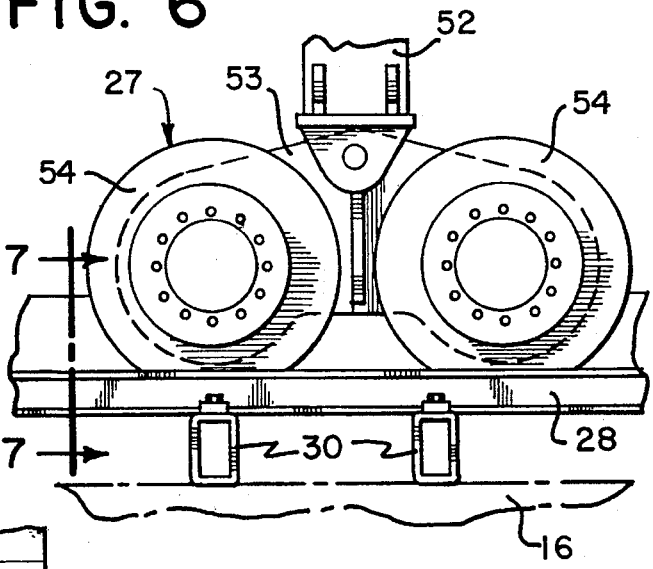
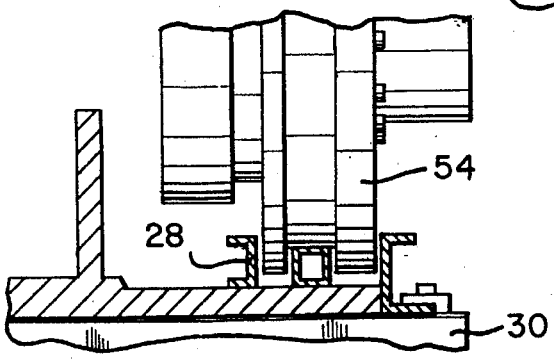
FIG. 7

BRIDGE CONSTRUCTION MACHINERY AND METHOD FOR CONSTRUCTING BRIDGES

FIELD OF THE INVENTION

This invention relates to apparatus and methods for constructing, repairing and maintaining highway bridges, and similar structures.

BACKGROUND OF THE INVENTION

In the construction of highway bridges extending over land or water and of the type including steel and/or concrete girders, it is necessary to position and later remove, forms used for supporting concrete poured between two adjacent girders (and along the outside edges of each outermost girder), during the formation of the bridge deck (which will eventually support the traveling surface of the bridge). When the concrete cures, thus forming the bridge deck, the metal or wooden forms which are used to support the poured concrete (hereafter called "forms") are removed from below, typically being lowered onto a barge or truck using a winch or crane.

Several devices have been developed to assist in the placement and removal of the forms. U.S. Pat. No. 2,639,950 issued to Wheeler, for example, discloses a device which includes a travelling derrick assembly having a scaffold which is supported below the bridge girders. The scaffold is assembled on and supported by two parallel beams extending across the width of the bridge. Each end of the two beams hangs from a travelling derrick which operates along the completed bridge road surface. Several winches and cranes are used to separate and manipulate the two beams around obstructions, such as the supporting pilings, encountered as the entire device moves along the length of the bridge.

Although the device of U.S. Pat. No. 2,639,950 could be used to assist in lifting forms to a position lying just below the bridge girders, the device still requires workmen to lift and assemble each lifted form into a locked and supporting position between two girders. Furthermore, the procedure required to prevent the scaffold from hitting obstacles, such as pillars, is awkward, slow and includes several dangerous steps.

OBJECTS OF THE INVENTION

An object of the invention is to provide apparatus for use in the construction and repair of bridges which overcomes the problems of the prior art.

A further object is to provide bridge construction apparatus for placing and removing forms which is portable, easily adaptable to any size bridge, and easy to operate.

A further object is to provide bridge construction apparatus which allows workers to safely and easily place forms into position to support the concrete placement of bridge decks and quickly remove them, when necessary, for reuse.

A further object is to provide a method for safely and efficiently positioning and removing forms during the construction of a bridge.

An additional object is to provide a bridge construction apparatus which quickly and efficiently lifts forms into a usable position for the placement of concrete on prepositioned girders.

A still further object is to provide a bridge construction apparatus which quickly and efficiently removes the forms from adjacent the girders of the bridge, lowering them onto a truck or barge.

A still further object of the invention is to provide a method by which the bridge construction apparatus may be quickly and easily moved to avoid any obstacles, as the apparatus travels the length of the bridge.

Yet another object is to provide a bridge construction apparatus which quickly and efficiently moves the forms to and from adjacent the girders of the bridge without outside crane assistance.

SUMMARY OF THE INVENTION

Apparatus for removing forms from a position adjacent the girders of a bridge (either between two adjacent girders or along the outer side of an edge girder, i.e., an outside overhang area) on bridges of the type which include longitudinally spaced apart piers having pier caps extending a finite distance transversely (across the bridge). The pier caps support logitudinal parallel girders which, in turn support a roadbed. The apparatus comprises a frame structure, a generally vertical support attached to the frame structure which is positioned along a side of the bridge. A portion of the apparatus is located below the bridge.

In accordance with one embodiment of the invention, the apparatus includes at least two support arms which are pivotally attached to the vertical support. The support arms are pivotal between an operative position under at least one bridge girder and a stowed position generally parallel to the girders. The support arms in the operative position are generally parallel to each other and spaced apart a predetermined distance. The support arms in the stowed position are located away from the bridge. A carriage having a length which is at least equal to the predetermined distance is supported by and movable along the support arms.

Means is provided for moving the carriage along the length of the support arms under the girders. Means is also provided for supporting the carriage at an accessible location out from under the bridge when the support arms are in the stowed position.

The forms may be removed from adjacent the girders onto the carriage and transferred to the accessible location out from under the bridge.

BRIEF DESCRIPTION OF THE DRAWINGS

FIG. 6 is an enlarged side view of a wheel assembly of the form placer;

FIG. 7 is an enlarged front view of the wheel assembly of FIG. 6, taken along the lines 7—7 of FIG. 6;

FIG. 11 is a partial sectional front view of a vertical support showing details of a height adjustment system in accordance with the invention;

FIG. 14 is a sectional front view of a portion of a telescoping horizontal carriage support arm;

DETAILED DESCRIPTIONS OF THE PREFERRED EMBODIMENTS

Figure 1:
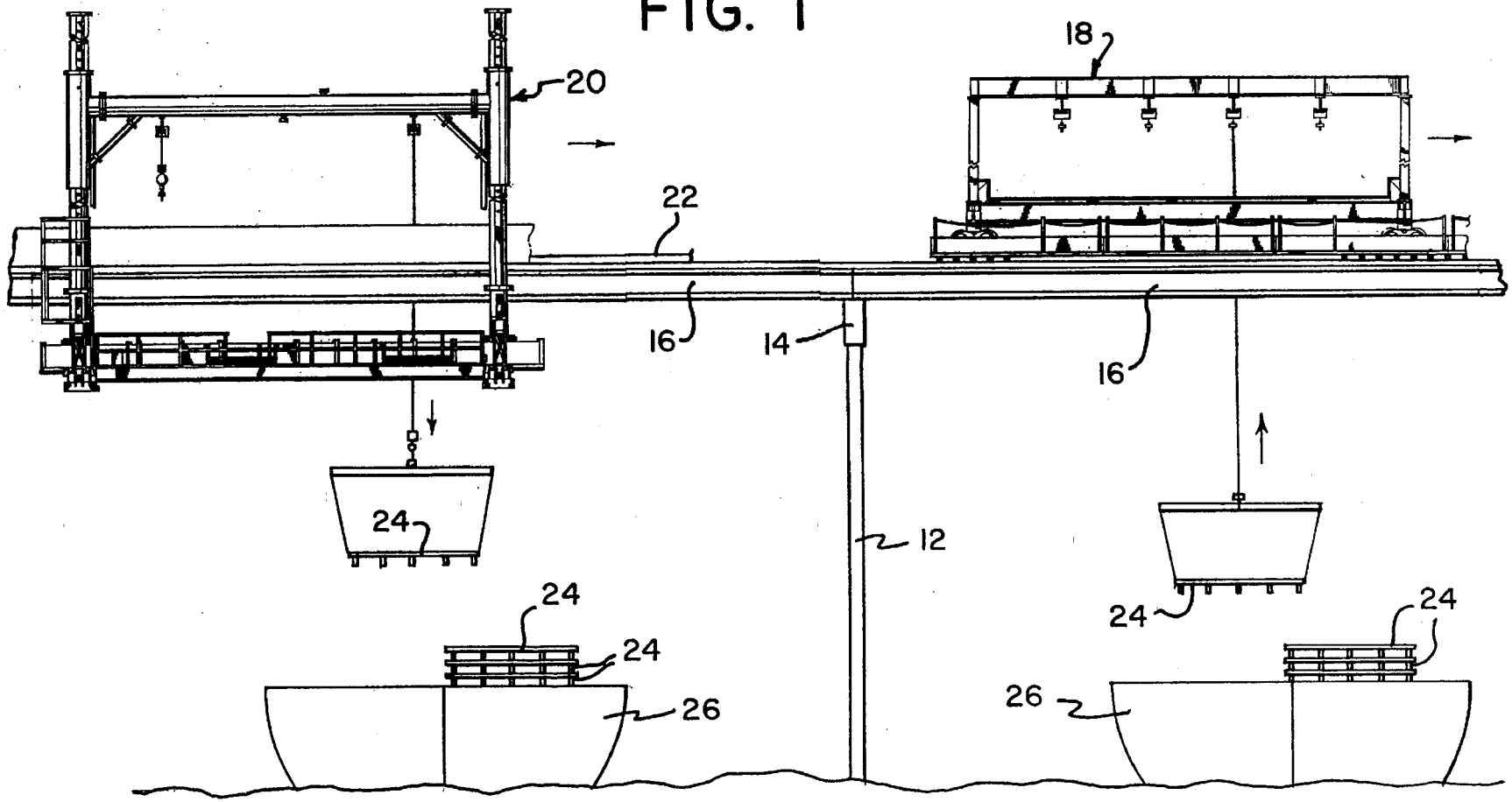
FIG. 1 is a schematic plan view of a part of a bridge being built in accordance with the present invention.

Referring to FIG. 1, there is shown a section of a typical highway bridge 10 under construction, for example, over a volume of water, such as a river. The bridge 10 includes pilings 12 (only one side of pilings is shown) which are appropriately driven (or otherwise secured to the underlying ground). A group of pilings 12 generally supports a transversely disposed cap 14. Spanning between and supported by each cap 14 are girders 16.

In accordance with the invention, a form placer apparatus 18 (hereinafter called "form placer") operates along the bare girders 16, as described below. Also, in accordance with the invention, a form stripper apparatus 20 (hereinafter called "form stripper") operates an appropriate distance behind the form placer 18, travelling along a newly formed (and cured) concrete bridge deck 22.

The form placer 18, as described in greater detail below, lifts forms 24 from an appropriate transport vehicle 26 (such as a barge or truck, depending on the location of the bridge), into position adjacent the bridge girders 16 (either between two adjacent girders or along an outer side of an edge girder, i.e., a girder that is located along the edge of the bridge). Concrete is poured along a prepared section of the bridge wherein forms 24 are locked in a supporting position and are ready to support the poured (uncured) concrete in the forming of the bridge deck 22. The concrete is poured and trued to a desired angle using machines not directly related to the immediate invention and therefore not shown.

When the poured concrete eventually cures, and the bridge deck 22 is established, the form stripper 20 travels over it and assists in removing the forms 24 from between the girders 16 (or along the edge girders 16), relocating them onto another transport vehicle 26 to be used again further along the bridge 10.

FORM PLACER MACHINE

Referring to FIGS. 2–7, details of the form placer 18 are shown in accordance with the invention. The form placer 18 is essentially a traveling gantry which includes wheel assemblies 27 that engage with and travel along pre-mounted rail sections 28. The rails 28 are mounted along the top of the open girders 16 using tie blocks 30. A cat walk assembly 32 including a safety fence 34 is also attached to the upper surface of the girders 16 (the outer most girders).

The form placer 18 is made from a frame structure including a generally rectangular lower frame assembly 36, and a generally rectangular upper frame assembly 38. The lower frame assembly 36 includes a front lower cross member 40, a rear lower cross member 42, two parallel lower side beams 44. The upper frame assembly 38 is made up of a front upper cross member 46, a rear upper cross member 48, and two upper side beams 50. Four vertical supports 52 are located at the four respective corners of the two frame assemblies 36, 38. The upper frame assembly 38 is supported above the lower frame assembly by the four vertical supports 52.

Each wheel assembly 27 includes a wheel frame 53 and preferably two wheels 54 which engage with and travel along the previously secured rails, as discussed above. At least one wheel assembly 27 is power-driven, preferably each wheel assembly 27, using either an electric motor, or a preferred hydraulic motor (not shown).

Figure 2:
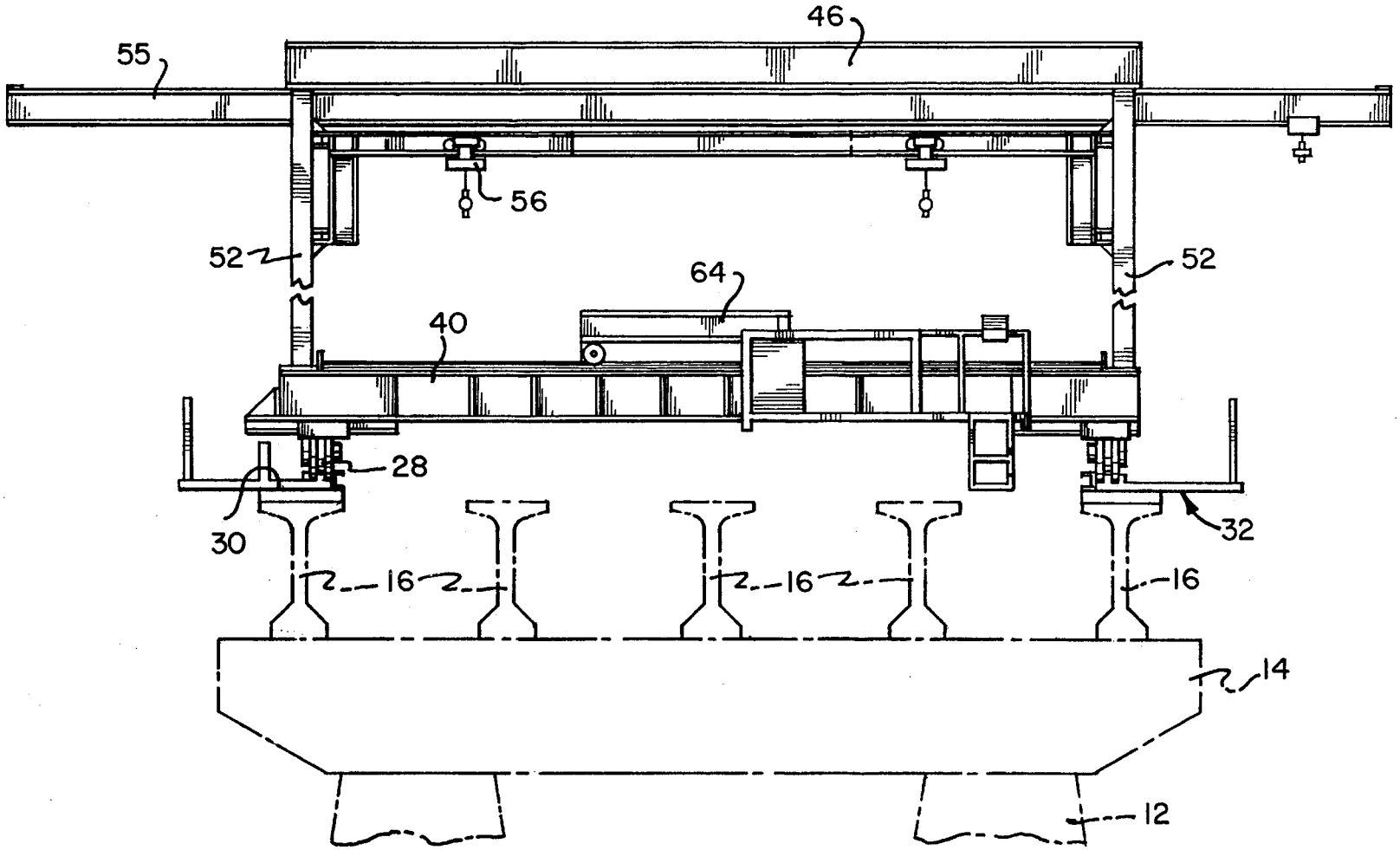
FIG. 2 is a front view of the form placer, in accordance with the invention, shown in an operative position on the girders of a bridge.
Figure 3:
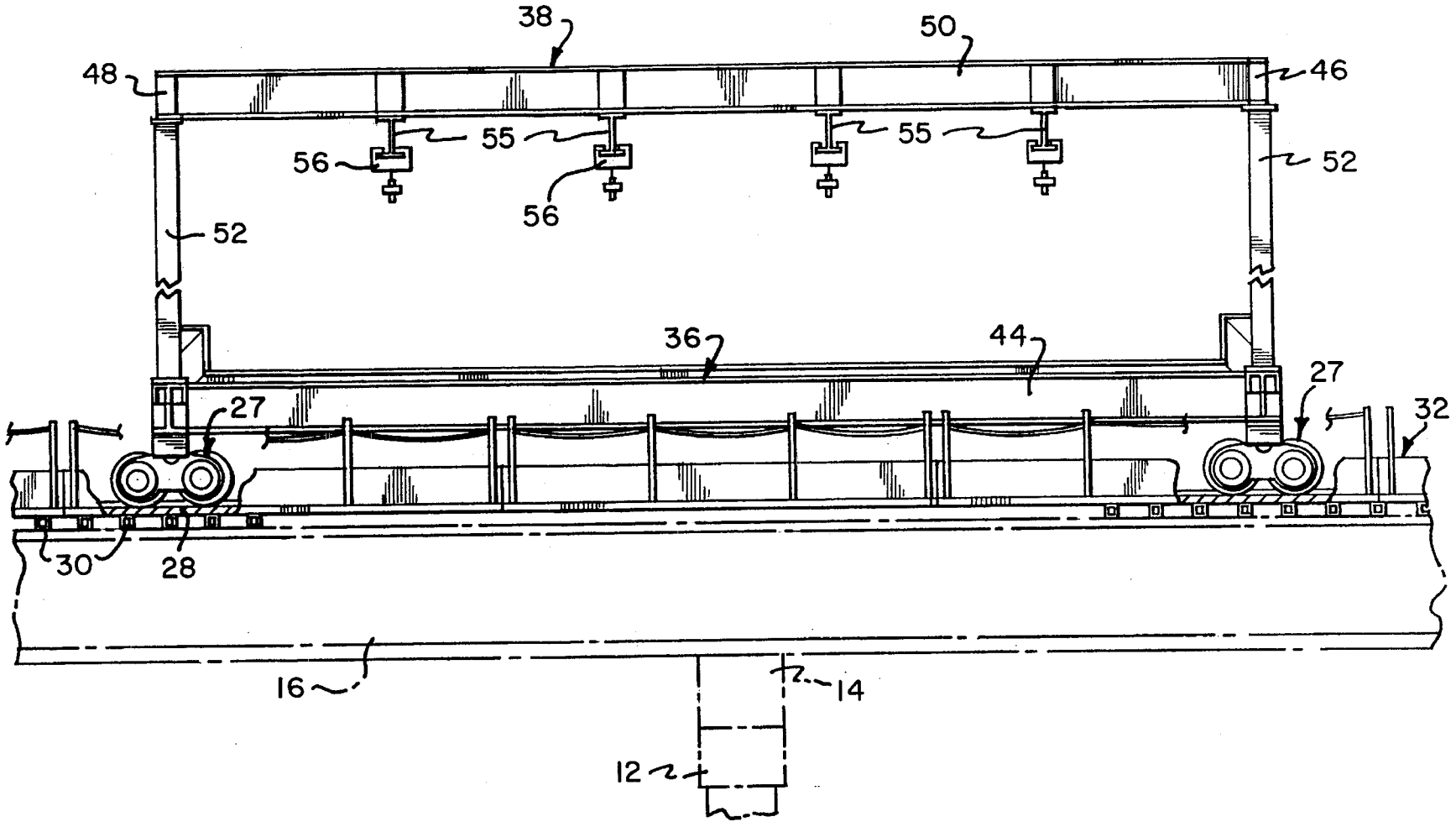
FIG. 3 is a side view of the form placer of FIG. 2, shown in the operative position.
Figure 4:
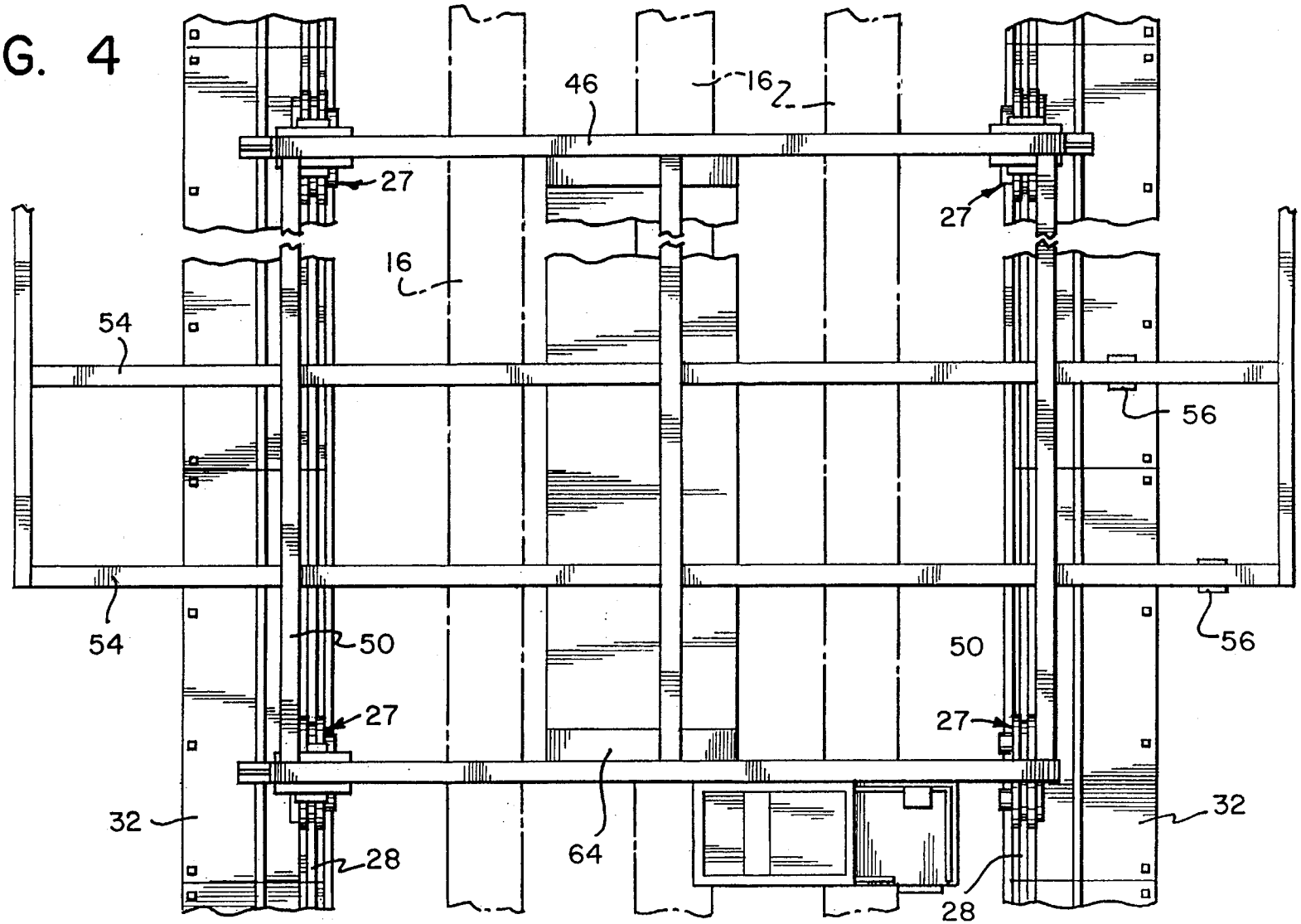
FIG. 4 is a partial top plan view of the form placer of FIG. 2.

Attached to and supported by the two parallel upper side beams 50 are a plurality of hoisting supports 55, which support conventional traveling hoists 56. The hoisting supports 55 are preferably longer than the upper cross members 46, 48 and extend out over each side of the outermost bridge girders 16, as shown in FIG. 2. The hoists 56 are used to lift either forms 24 or rails sections 28, as described below.

Figure 5:
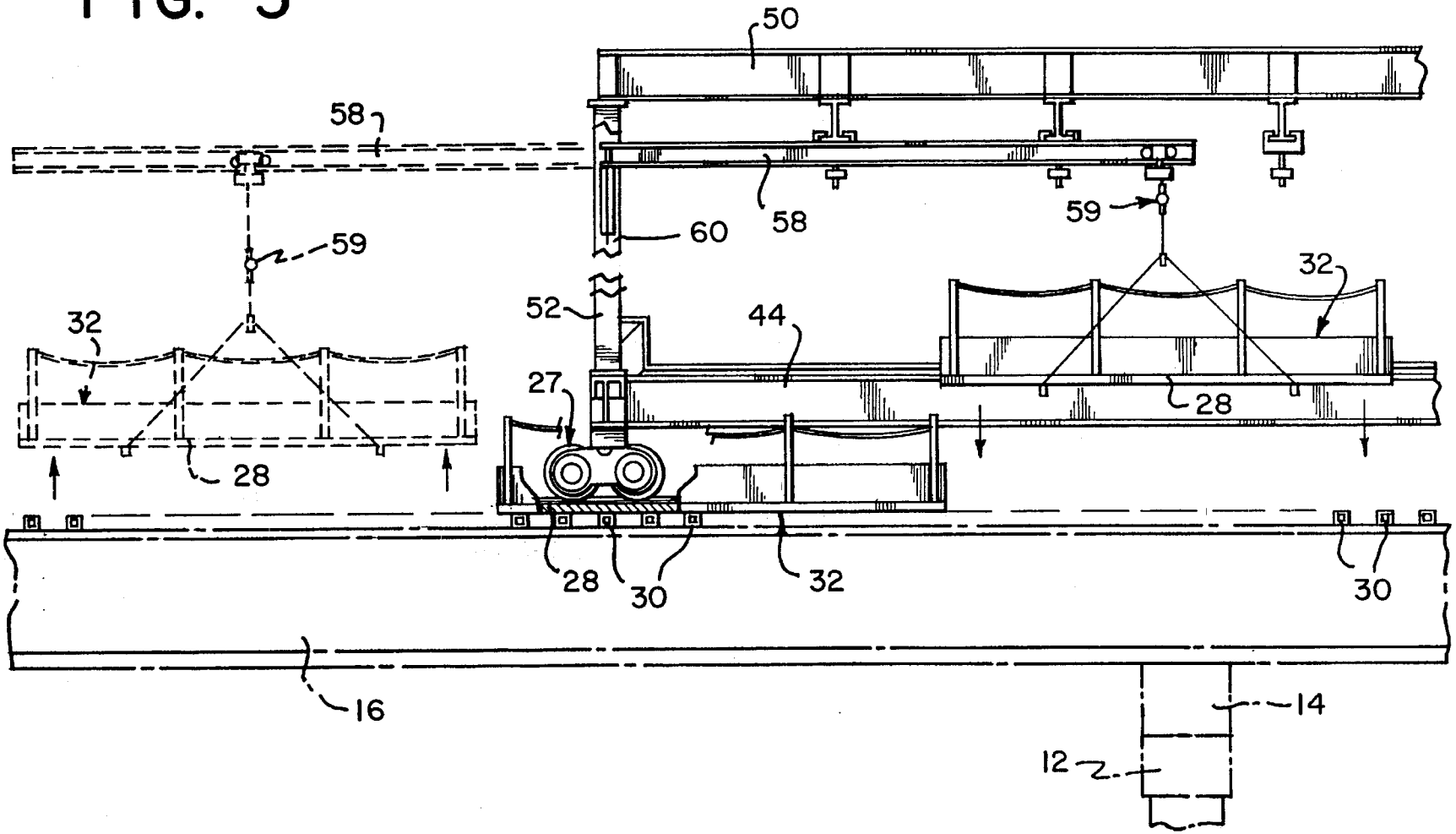
FIG. 5 is a partial side view of a crane feature of the form placer, in accordance with the invention, showing a rail section being moved from a first position to a second position.
Figure 8A:
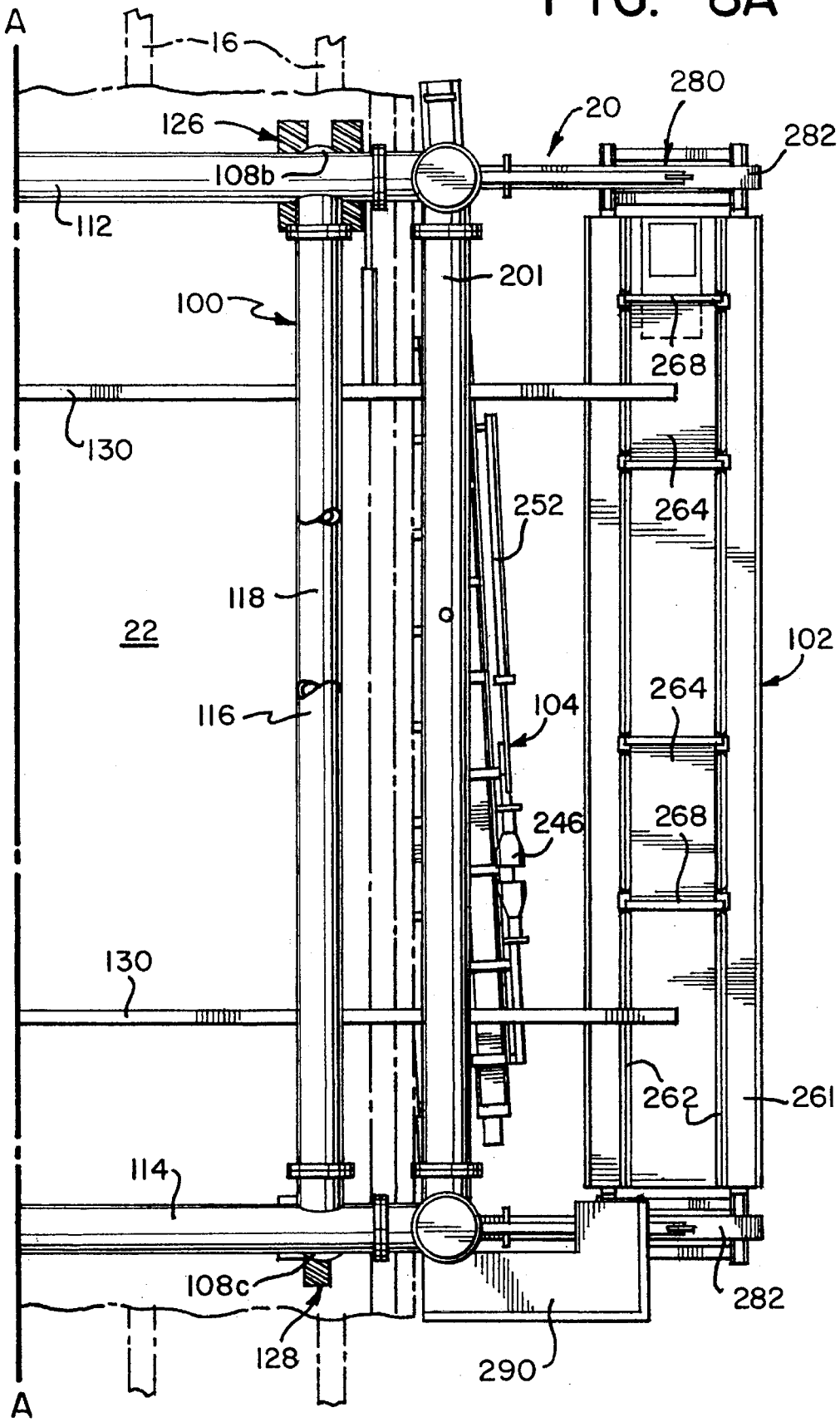
FIG. 8A is a right side top view of a form stripper, in accordance with the invention, matching with match line A—A of FIG. 8B.
Figure 8B:
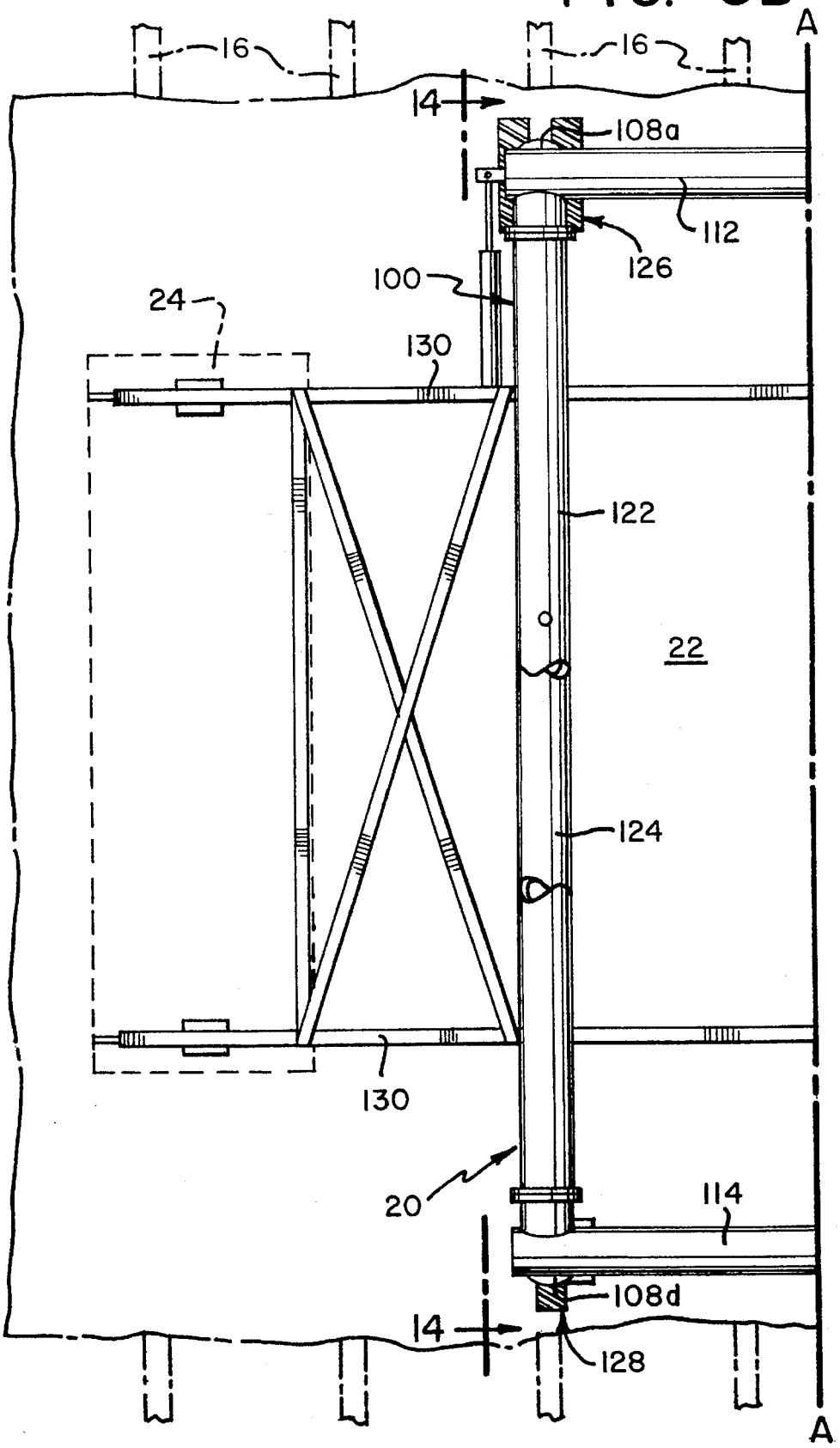
FIG. 8B is a left side top view of the form stripper, matching with match line A—A of FIG. 8A.
Figure 9:
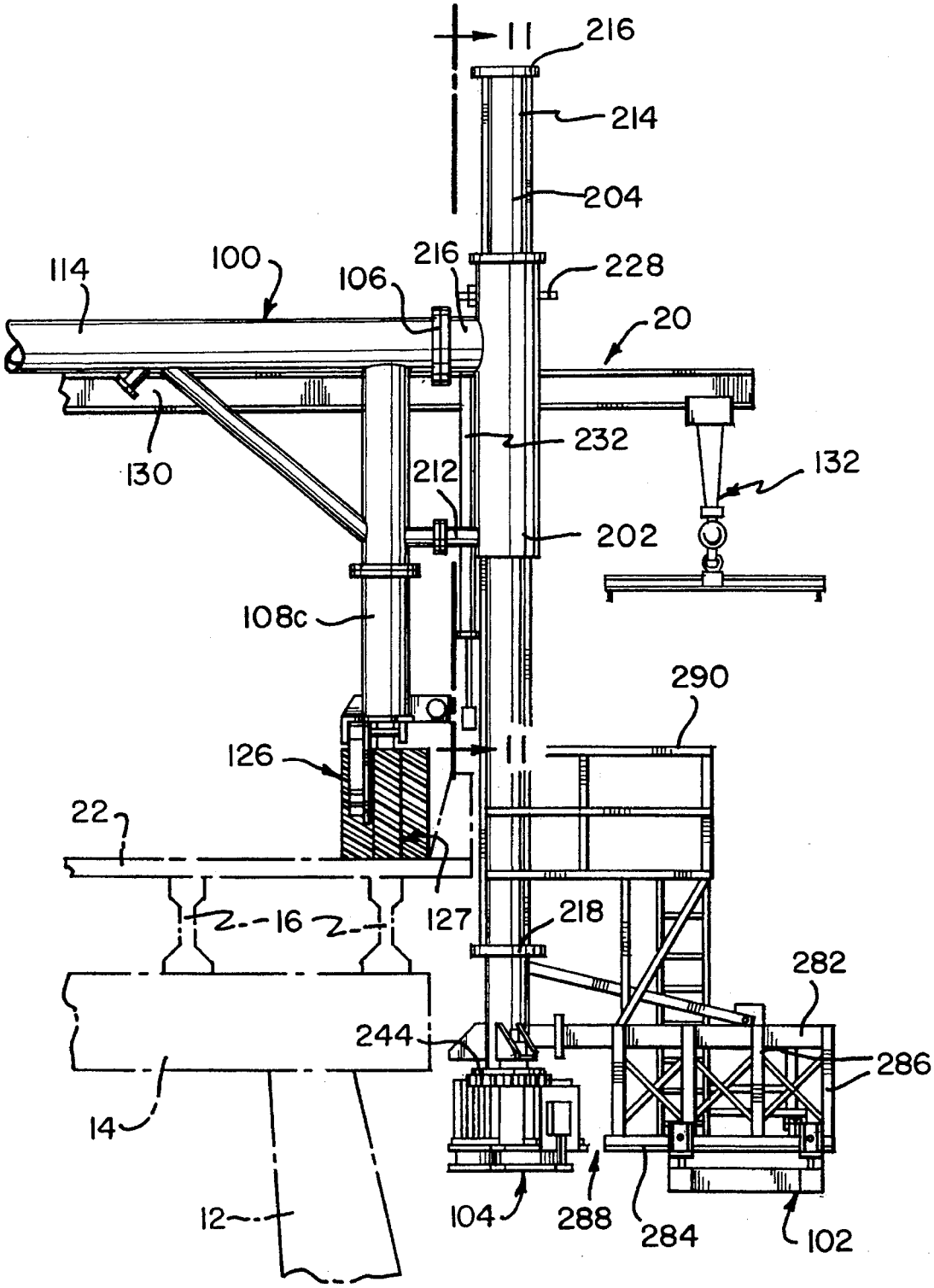
FIG. 9 is a partial front view of the form stripper showing details of a carriage and a carriage support assembly.

Referring to FIG. 5, in the preferred embodiment of the form placer machine 18, a corner crane 58 (with its own winch assembly 59) is mounted along an inside surface 60 of each vertical supports 52. Each crane 58 is mounted to the inside surface 60 of each vertical supports 52 using a pivotal bracket 62 which enables each crane 58 to swing 180 arc degrees between a rearward orientation (shown, for example in dashed lines in FIG. 5) for lifting objects located behind the particular vertical supports 52 and a forward orientation, located ahead of the particular vertical supports 52 (represented in FIG. 5 as solid lines). The purpose of the cranes 58 is to assist in transposing the heavy rail sections 28 from behind the form placer machine 18 to a location ahead of the machine 18. The transpositioning of the rails 28 allows the entire form placer machine to travel along the entire length of the bridge 10 using a conservative length of railing 28.

A hydraulic power generator (not shown) is attached to any appropriate structural element, such as the front lower cross member 40. The power generator 64 may be a conventional hydraulic pump powered by a conventional portable gas engine. The hydraulic power generator supplies the necessary power to operate the hydraulic motor used to drive the form placer machine 18 along the rails 28 and all the lifting hoists 56, 59.

As shown in FIG. 2, transversely disposed rails 61 are preferably provided extended between the two lower side beams 44 (the rails are parallel to these beams 44). A cart 64 is positioned on and movable along the rails 61. The cart 64 functions as a travelling support for temporarily storing either rail sections 28 or forms 24 (or any other heavy equipment).

FORM STRIPPER MACHINE

Referring to FIGS. 8–18, details of the form stripper machine are shown in accordance with the invention. The form stripper 20, as described above, operates on top of the newly poured (and cured) concrete bridge deck 22, located behind the form placer 18. The purpose of the form stripper 20 is to provide a safe and effective working platform (carriage) on which workmen may quickly and easily remove the heavy forms 24 from the girders 16.

The form stripper 20 includes three main sections; a frame structure 100, a carriage 102, and a carriage support assembly 104.

Referring to FIGS. 9, 12A, 12B and 15, the frame structure 100 includes four vertical supports 108; a front inner vertical support 108*a*, a front outer vertical support 108*b* (adjacent to the edge of bridge), a rear outer vertical support 108*c* (adjacent to the edge of the bridge), and a rear inner vertical support 108*d*. The two front vertical supports 108*a*, 108*b* are connected to each other at their respective upper ends 110 by a front upper cross section 112.

Figure 15:
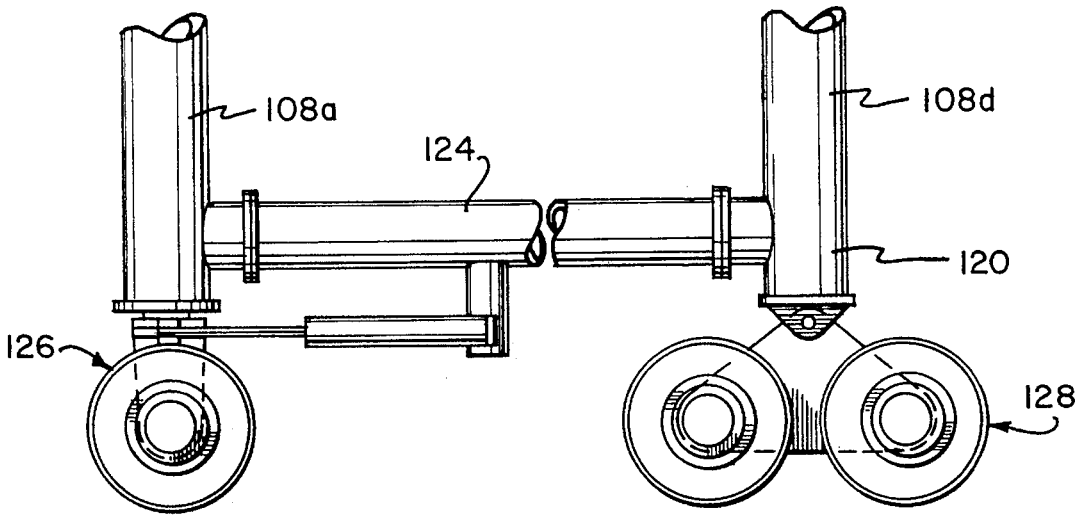
FIG. 15 is a partial side view of front and rear wheel assemblies of the form stripper, in accordance with the invention, showing details of a steering mechanism.
Figure 18:
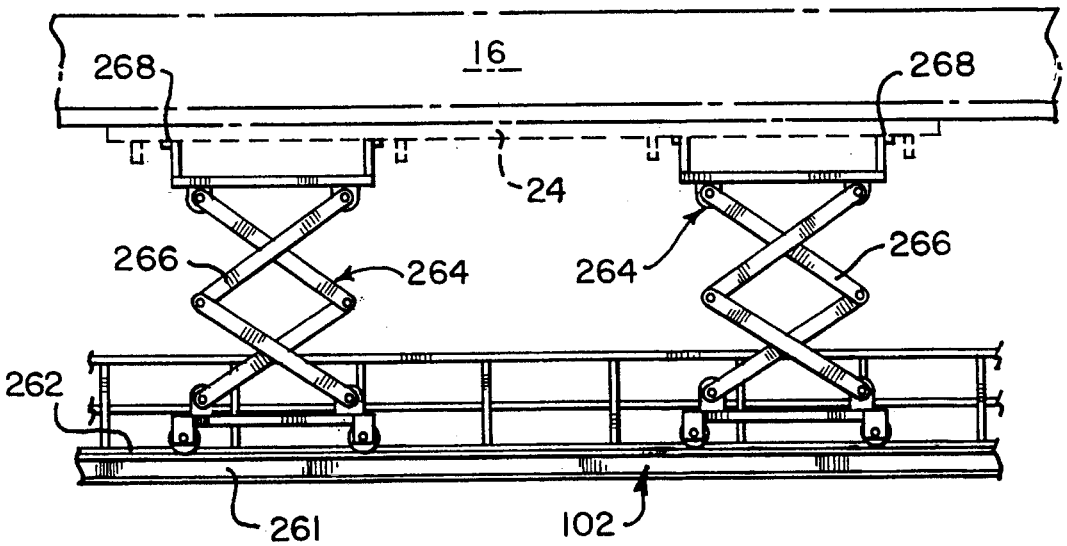
FIG. 18 is a partial side view of the carriage showing two scissor jacks moving a form with respect to the girders.

Similarly, the two rear vertical supports 108*c*, 108*d* are connected to each other at their respective upper ends 110 by a rear upper cross section 114. The two outer vertical supports 108*b*, 108*c* (the two supports that are adjacent to the edge of the bridge) are connected to each other with two parallel side beams. An upper outer side beam 116 connects the upper ends 110 of the two outer vertical supports 108*b*, 108*c*, as shown in FIG. 7*a*. A lower outer side beam 118 similarly connects the lower ends 120 of the two outer vertical suports 108*b*, 108*c*, as shown in FIG. 15. An upper inner side beam 122 connects the upper ends 110 of the inner vertical supports 108*a*, 108*d*, together. Similarly, as shown in FIG. 15, a lower inner side beam 124 connects the lower ends 120 of the same two inner vertical supports 108*a*, 108*d*, together. All the above described elements are preferably interconnected at right angles so that the vertical supports 108 remain normal to the bridge surface and the four cross sections 122, 124, 116, 118 remain parallel to the bridge surface (i.e., horizontal).

The frame structure 100 is preferably made from pipe sections. The pipe sections, which may be conventional, preferably include, at specific locations as discussed below, securing flanges 106.

The various elements discussed above may be attached to each other using any standard technique, such as brackets, flanges and bolts or clamps. It is preferred, however, that apart from certain connections, as discussed below, all the pipe sections are welded together. As shown in FIGS. 12*a*, 10, 15, 8 and 8*b* certain sections are bolted together using a conventional technique wherein two adjacent and abutting flanges 106 are secured to each other using through bolts. The use of flanges 106 and bolts allows the entire frame assembly 100 to be easily and quickly assembled, dissembled, and altered to accommodate bridges of various widths.

At the lower end 120 of the forward vertical supports 108*a*, 108*b* is a steerable wheel assembly 126. At the lower end 120 of the rear vertical supports 108*c*, 108*d* is a driven wheel assembly 128. It is not necessary for the driven wheel assemblies 128, to be steerable. The wheel assemblies 126, 128 are described in greater detail below.

As shown in FIGS. 12*a*, 12*b*, 10, 9, and 8*a*, 8*b*, preferably two parallel, horizontal hoist supports (such as two "I"-beams) 130 are secured to and supported by both upper side beams 116, 122 and cross beam 201. The two hoist supports 130 are attached to the two side beams 116, 122 and cross beam 201 so that an appropriate hoist assembly 132 may freely travel along the entire length of each hoist supports 130 (i.e., one hoist per beam). As further discussed below, the purpose of the hoist supports 130 and the hoist assembly 132 is to move forms 24 between a loading area 134 on the bridge and a working platform 136. The forms 24 are lifted by one or both of the hoist assemblies 132 and relocated across the bridge, moving through the frame structure of the form stripper 20, between upper and lower side beams. The forms 24 may also be directly lowered to a barge or truck after the carriage 102 is relocated back under the bridge.

The carriage support assembly 104, as shown in FIGS. 12A, 12B, 9, 13*a*, 8*a*, and 10 used to support and direct the underlying carriage 102 which is detailed below. The carriage support assembly 104 preferably comprises a front section 200*a*, and a rear section 200*b*. Both sections are similar in construction and are connected to each other by a cross piece 201. Both sections 200*a*, 200*b* include four main elements, a guide sleeve 202, a vertical support 204, a turret drive assembly 206, and a vertical adjustment assembly 208.

The guide sleeve 202 of the front section 200*a* is attached to the front outer vertical support 108*b* of the frame structure 100. The rear section 200*b* is attached to the rear outer vertical support 108*c*. Both the front and rear guide sleeves 202 are preferably parallel to their respective vertical support 108*a*, 108*c*. The guide sleeves 202 may be permanently secured to the vertical supports 108*b*, 108*c* by welding, for example, or attached thereto, in a removable manner, as a separate part. In this preferred embodiment, each guide sleeve is attached to its appropriate vertical support 108*b*, 108*c*, as described above, using a removable fastener, such as bolts. An upper extension 210 and a lower extension 212 are used as spacers to position the front and rear guide sleeve 202 a prescribed distance from the respective vertical support 108*b*, 108*c*, effectively extending the guide sleeve 202 (and the entire carriage support assembly 104) out a prescribed distance from the edge of the bridge (outermost girder). The length of the upper and lower extension 210, 212, respectively, may be increased by adding an appropriate spacer (not shown), depending on the type and shape of the particular bridge being built.

Figure 10:
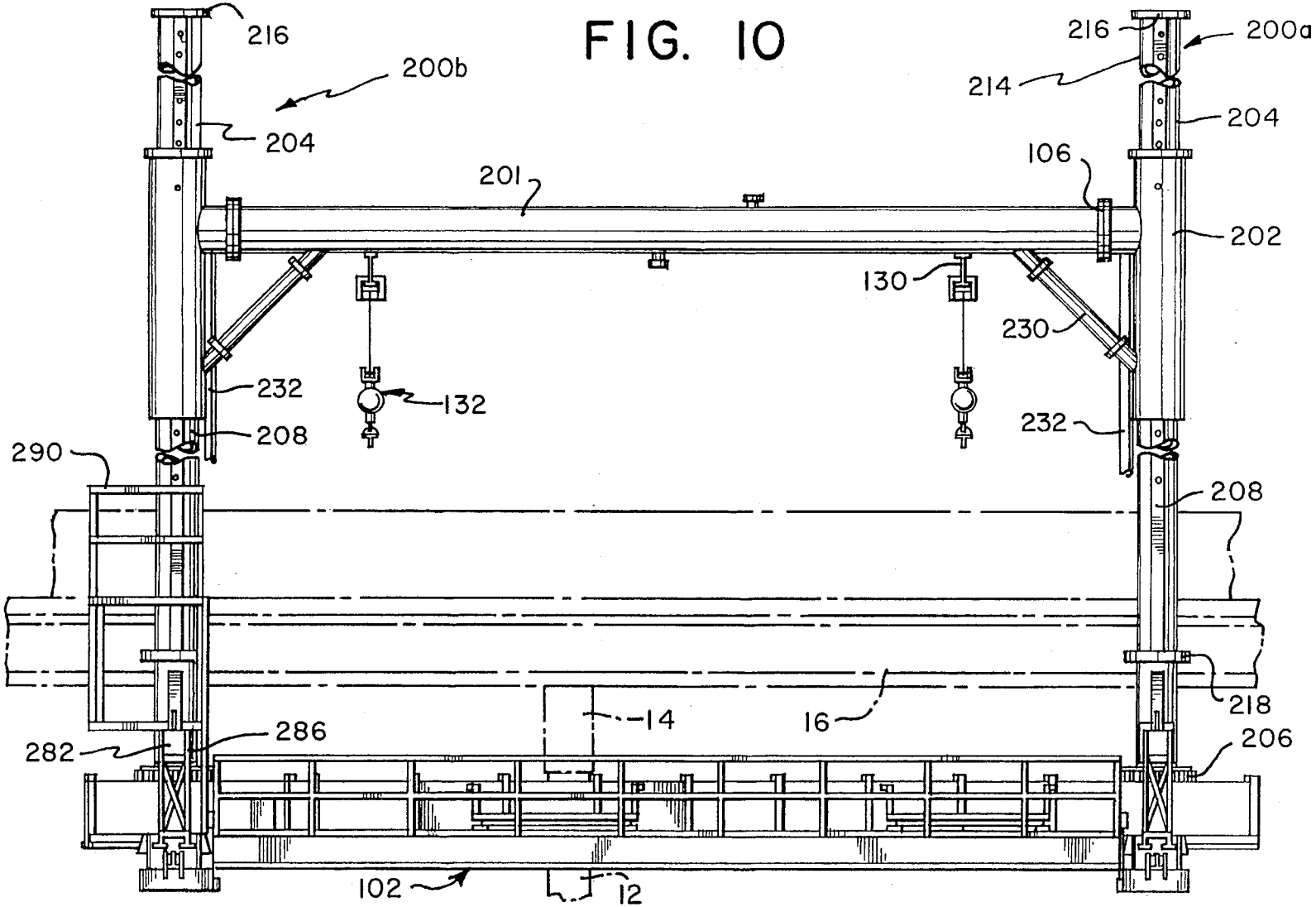
FIG. 10 is a side view of the form stripper showing details of the carriage support assembly.

Positioned and slidable within each guide sleeve 202 is the vertical support 204. The vertical support 204 is preferably tubular and has an outer diameter which affords a snug but slidable fit with the guide sleeve 202. In a preferred embodiment, Teflon (trademark) or similar friction-free material is used between the guide sleeve 202 and the vertical support 204. An upper end 214 of the vertical support 204 includes an upper stop flange 216. A lower stop flange 218 is located preferably towards a lower end 220 of the vertical support 204, as illustrated in FIGS. 10 and 11. A working region of the vertical support shaft 204 resides between the upper and lower stop flanges 216, 218, respectively and defines the length of shaft which is slidable within the guide sleeve 202.

The vertical support shaft 204 may be raised (as described below) to a fully raised position wherein the lower stop flange 218 contacts a lower portion of the guide sleeve 202, lowered to a fully lowered position wherein the upper stop flange contacts an upper portion of the guide sleeve 202, or locked to an intermediate working position, as shown in FIG. 10.

As described below in the method section of this specification, the vertical support shafts 204 of both the front section 200*a* and the rear section 200*b* are raised and/or lowered simultaneously or individually by the vertical adjustment assembly 208 to a desired height.

The vertical support shafts 204 of both the front and rear sections 200*a*, 200*b*, include two aligned linear arrays of openings 224 wherein one linear array is located opposite the other and both extend longitudinally along each respective support shaft 204, within the working region 222. Any two opposing openings 224 of each support shaft may align (when the support shaft 204 is moved with respect to the guide sleeve 202) with a locking opening 226 which is located within the walls of each guide sleeve 202. A suitably sized locking pin 228 may be inserted along a horizontal axis through a first locking opening 226 of a guide sleeve 202, two aligned openings 224 and then, another, opposing locking opening 226.

The purpose of the openings 226 and 224 and the locking pin 228 is to lock the support shaft 204 at a predetermined position with respect to the guide sleeve 202. The position of the support shafts 204 (front and rear) with respect to their respective guide sleeves 202 dictate the distance between the carriage assembly 102 and the girders of the bridge, as discussed below.

As shown in FIG. 10, a brace arm 230 is positioned angularly between each guide sleeve 202 and the adjacent cross piece 201. The cross piece 201, the guide sleeve 202 and the brace arms 230 are all preferably easily separable from each other to facilitate quick and easy, transport, assembly and modifications.

The height of each support shaft 204 with respect to their respective guide sleeve 202 is controlled by at least one lifting mechanism. In this preferred embodiment, two hydraulic actuators 232 are used; one for raising or lowering each respective support shaft 204. As shown in FIGS. 10 and 11, an upper (cylinder) portion 234 of each hydraulic arm 232 is connected, using any appropriate means (clamps, welding, bolts, etc.) to any portion of the guide sleeve 202. The upper portion 234 could also be attached to any portion of the frame structure 100. A lower (piston) portion 236 of each respective hydraulic arm 232 is connected to any appropriate portion of the respective support shaft 204.

In operation of the hydraulic actuator 232, as described in greater detail below, the relative height of each support shaft 204 may be easily changed with respect to each guide sleeves 202. Once the carriage 102 is located at a desired distance from the bridge girders, the locking pin 228 may be inserted into the aligned locking openings 226 and 224. The lower portions 236 of each hydraulic actuators 232 may be removed from the connection point 233 of the support shaft 204 and fully retracted to protect the piston shaft from exposure damage.

Figure 13A:
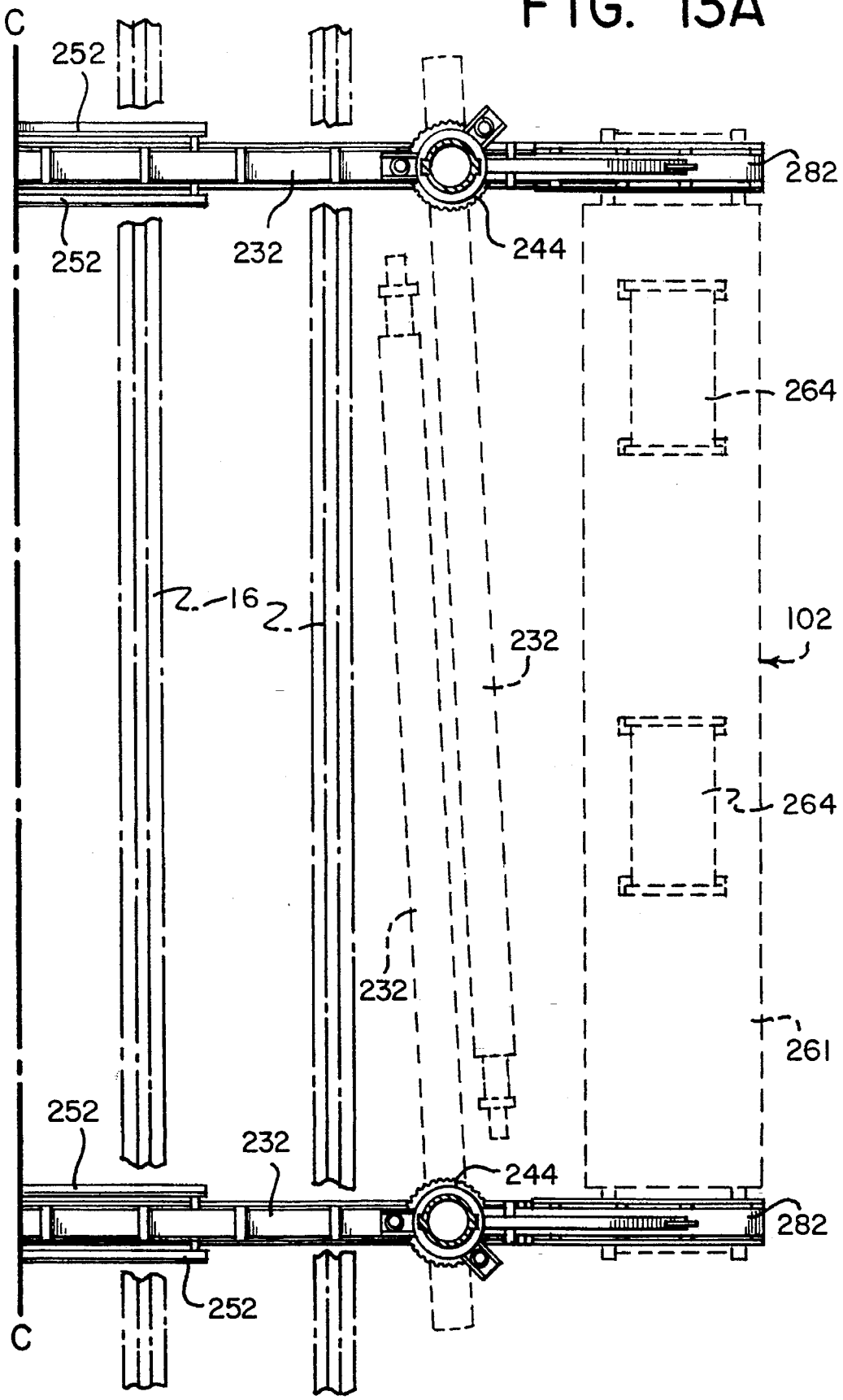
FIG. 13A is a right side top view of the form stripper taken along the lines 13—13 of FIG. 12, matching with match lines C—C of FIG. 13B.
Figure 13B:
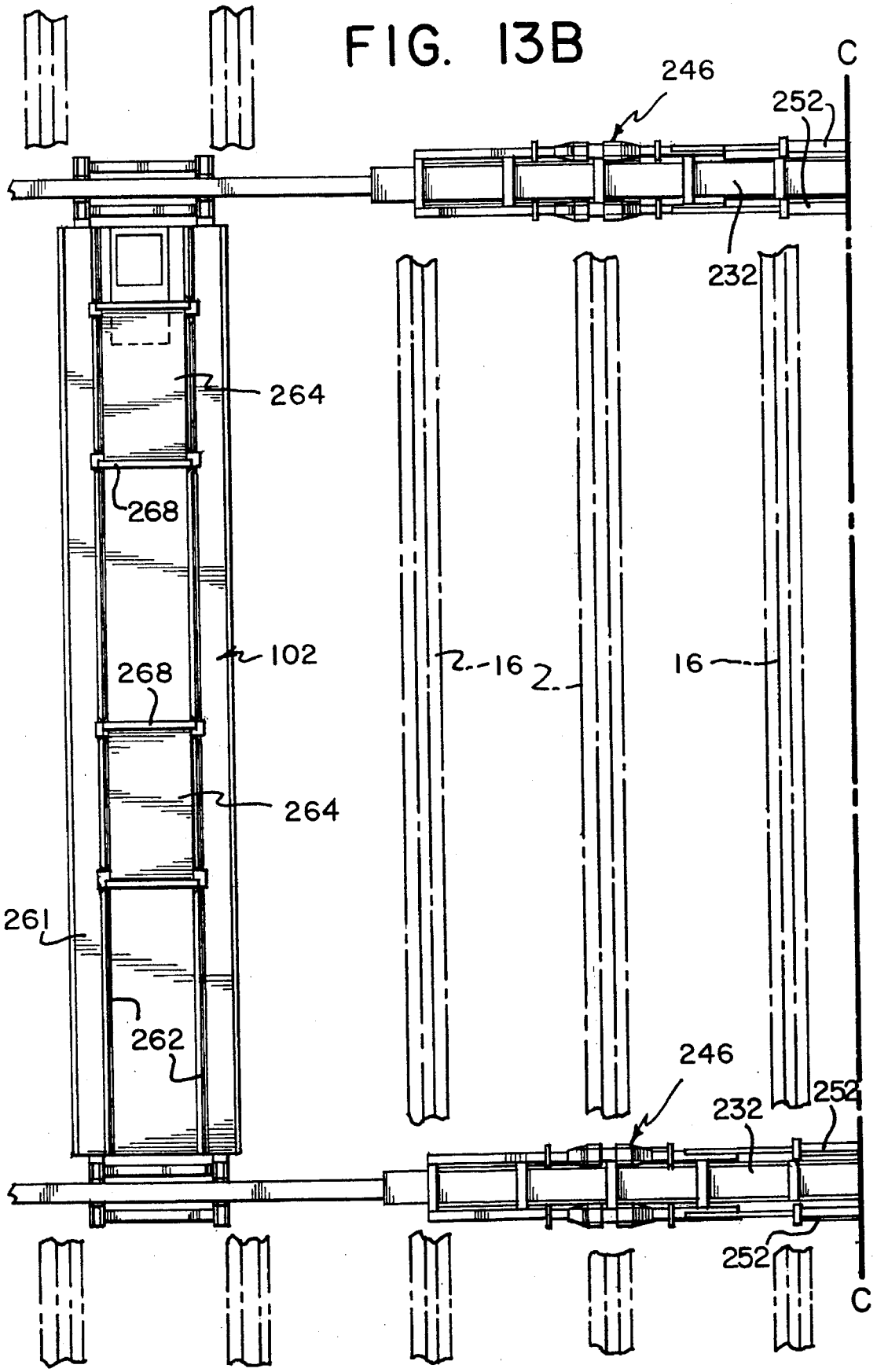
FIG. 13B is a left side top view of the form stripper taken along the lines 13—13 of FIG. 12, matching with match lines C—C of FIG. 13A, showing the horizontal carriage support arms in a fully deployed position (in solid lines), and in a fully stowed position (in dashed lines)

Each support shaft 204 extends a short distance below the lower stop flange 218. Front and rear horizontal carriage support arms 238 are pivotally attached to each respective lower end 220 of each support shaft 204 in such a manner to allow them to independently pivot within a horizontal plane which is generally parallel to the girders 16. Each carriage support arm 238 is pivotal between a stowed position, wherein each arm 238 is generally parallel to the girders of the bridge 10 as shown in FIG. 13A (dashed lines), and an operative position wherein each arm 238 lies generally perpendicular to the girders 16 of the bridge 10 (also shown in FIG. 13*a*, 13*b*, in solid lines). In the operative position, the carriage support arms 238 lie below the girders and extend across preferably at least half the width of the bridge. A telescoping extension arm 242 is preferably included within each carriage support arm 238 and may be deployed therefrom to allow each arm 238 to extend across, and therefore provide the supported carriage 102 access the entire width of the bridge, as described below, and shown in FIG. 14.

A turret gear 244 is attached to the bottom of each support shaft 204. The turret gear 244 is held stationary with respect to the support shaft 244. Each carriage support arm 238 is pivotally attached just below each respective turret gear 244 to each respective support shaft 204 by way of a bearing (not shown). The bearing bears all torsional and moment loads exerted through each respective arm 238 and ensures smooth and level pivot movement between the stowed position and the operative position. An electric or hydraulic motor (not shown) is attached to each carriage support arm 238 so that a drive pinion (not shown) attached to and rotatable by the shaft of the motor is engaged with the larger turret gear. When either motor is activated, the pinion effectively drives along the stationary turret gear, resulting in horizontally pivoting the particular carriage support arm 238 about the particular support shaft 204.

Figure 16:
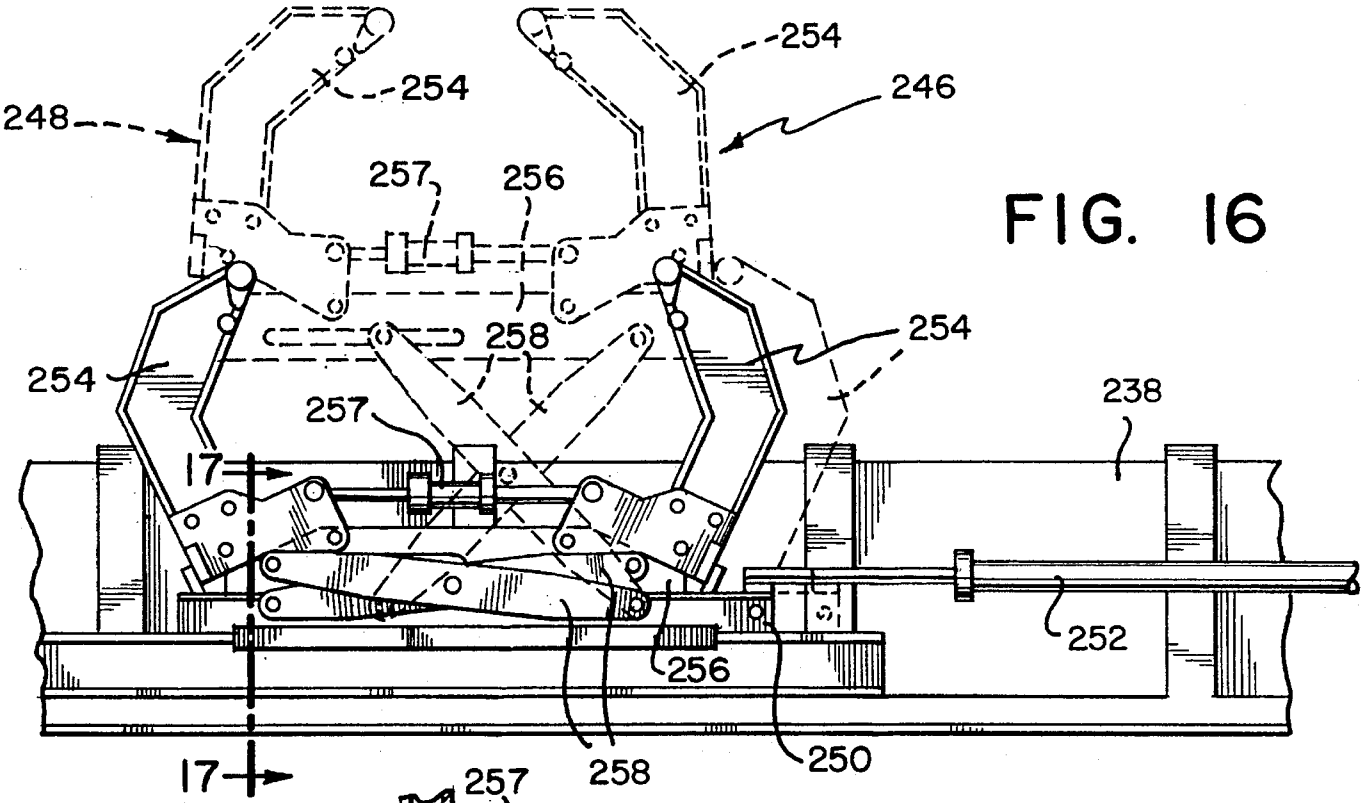
FIG. 16 is an enlarged view of a girder gripping assembly of the form stripper machine, in accordance with the invention.
Figure 17:
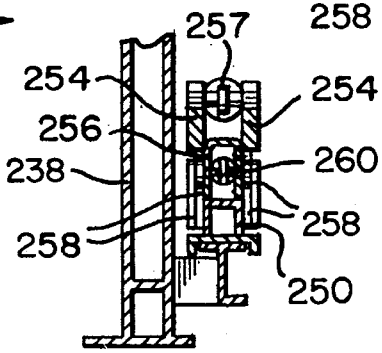
FIG. 17 is a partial sectional view of a portion of the girder gripping assembly, taken along the lines 17—17 of FIG. 16.

Attached to each carriage support arm 238 is a girder gripping assembly 246. Each girder gripping assembly 246, which is preferably located near the remote end of each respective carriage support arm 238, is used to help support each respective carriage support arm 238 by frictionally engaging a portion of a girder 16. Each girder gripping assembly, as shown in FIG. 16, includes a gripping section 248 and a base section 250. The base section 250 is slidably attached to its particular support arm 238 and may be displaced a predetermined amount along the support arm 238 by an hydraulic actuator 252. The gripping section 248 includes two opposing claws 254 which are pivotally attached to a frame 256 and may move between an open and closed position by an hydraulic actuator 257. The two opposing claws 254 are shaped and sized to engage with the lower portion of standard (or any) bridge girders 16, including standard steel I-beam type, steel with concrete type, and prestressed concrete type. The entire gripping section 248 is connected to the base section 250 through two pairs of ("scissor jack") pivoting arms 258 which operate in a conventional manner to raise and lower the gripping section 248 with respect to the base section 250 so that the gripping section 248 remains parallel (horizontal) to the base section 250 and also the carriage support arms 238. Another hydraulic actuator 260 is employed to manipulate the pivoting arms 258 and thereby control the relative height of the gripping section 248.

The carriage 102, introduced above, functions as a working platform allowing workmen to safely work adjacent the girders 16. The carriage 102 is also a transport device for removing the heavy forms 24 from the girders 16 and then moving them to an accessible area (i.e., to one edge of the bridge 10) so that they may be removed from the site in accordance with one aspect of the invention. The carriage 102 includes a horizontal platform 260 which includes to longitudinal rails 262 which are parallel to the girders 16. Operative along the rails 262 is a raisable platform jack assembly 264 which may be conventional, typically including two pairs of pivoting arms 266 which may be manipulated to raise and lower a load surface 268 with respect and parallel to the platform 261. The jack assembly 264 may be positioned anywhere along the length of the carriage 102 and may be used to lower a heavy form 24 from between two girders 16 onto the carriage 102.

The carriage 102 includes wheels 270 located at each end which are adapted to travel within and be supported by tracks 272. The tracks 272 are attached to each carriage support arm 238. In this preferred embodiment, two separate tracks 272 are provided on each support arm 238, one track 272 on each opposing vertical surface 274, as shown in FIG. 14. The structure of the tracks 272 and the wheels 270 allows the carriage 102 to travel under the girders 16 of the bridge 10 while remaining parallel to the girders 16. The carriage 102 effectively suspends from and is supported by the tracks 272. The tracks 272 extend the length of each respective support arm 238 and the telescoping extension arm 242 so that the carriage 102 may travel the entire width of the bridge 10.

Figure 12A:
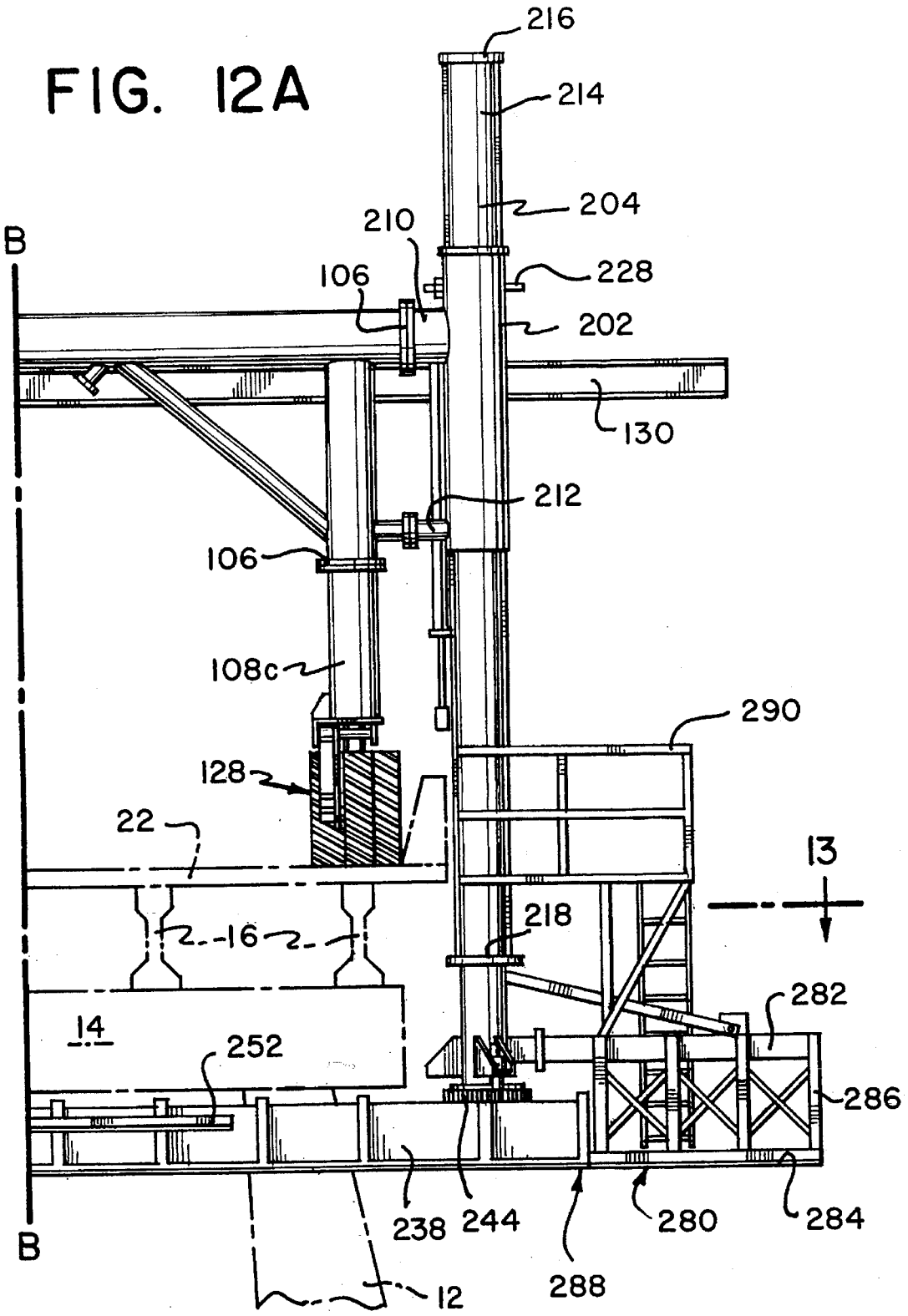
FIG. 12A is a right side front view of the form stripper machine showing horizontal carriage support arms deployed under the bridge girders, matching with match line B—B of FIG. 12B.
Figure 12B:
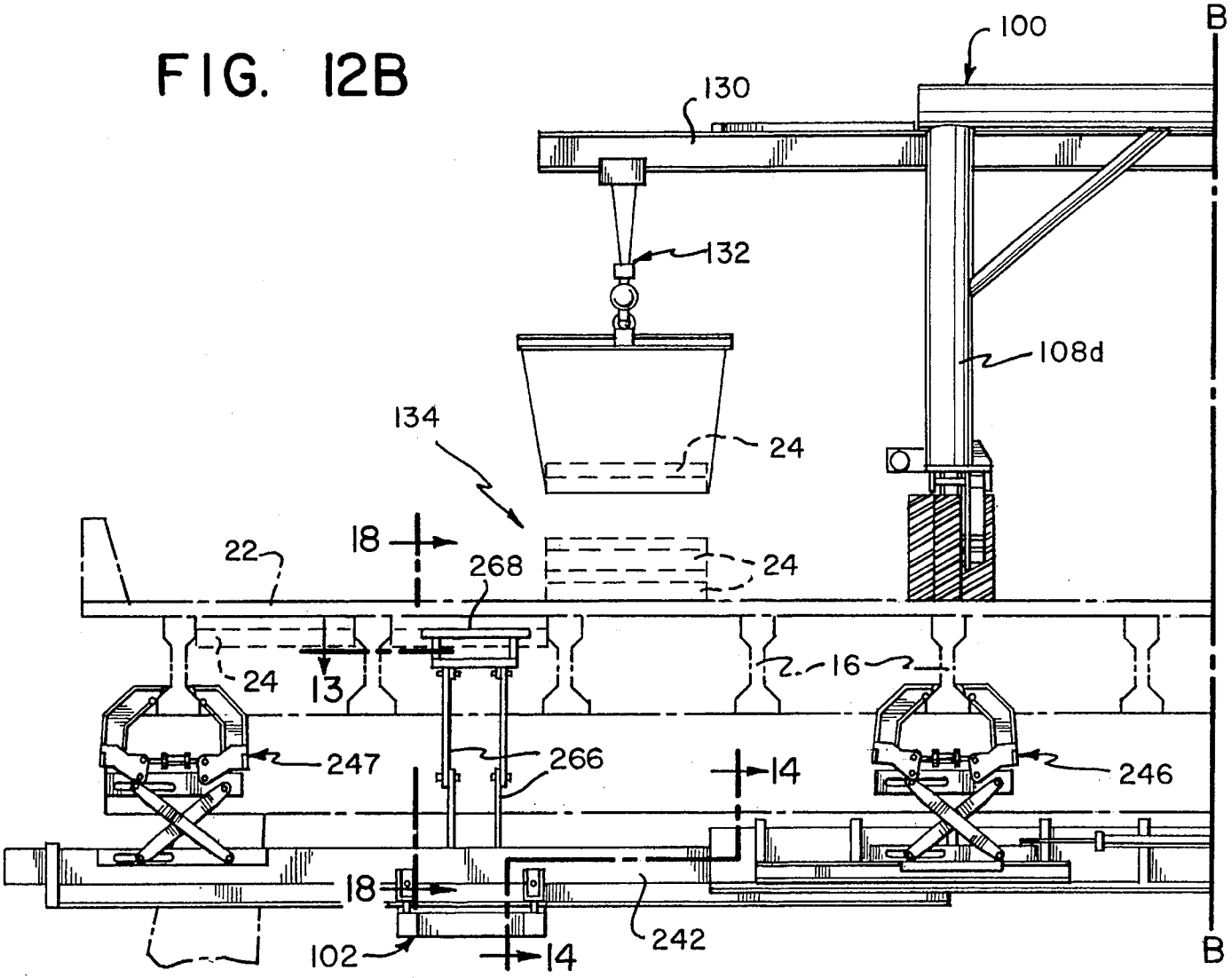
FIG. 12B is a left side front view of the form stripper machine showing a form being removed from between the girders, matching with match line B—B of FIG. 12A.

A carriage holding frame 280 is located opposite the support arms 238 and is used to hold the carriage 102 whenever the carriage support arms 238 are not in their operative position, as shown in FIG. 12A, 12B. The carriage holding frame 280 is defined by two parallel horizontal supports 282 which are attached to respective lower portions of the vertical support shafts 204. Two sets of supplemental track sections 284 are supported by each respective support 282, hung in position by vertical bars 286. The track sections 284 of each support 282 are sized to align with the track 272 (at transition point 288) of each respective support arm 238 when in the operative position, such as shown in FIG. 12A, 12B. The carriage 102 may be moved from its operative position supported by the track 272 of support arms 238, cross over the transition point 288, and enter the stowed position wherein the carriage 102 is supported by the track sections 284. When the carriage 102 is located in the stowed position, it is being independently supported by the supports 282, thereby allowing the carriage support arms 238 to move freely from their operative position (shown in FIG. 13A, 13B) to a folded stowed position, as shown in FIGS. 13A (dashed lines) and 8A.

An appropriate cat walk structure 290 may be affixed to one of the support shaft 204 and a corresponding support 282. The cat walk structure 290 may include steps providing workmen easy and safe access between the bridge deck 22 and the carriage 102, when the carriage is in its stowed position. Either support 282 may additionally support hydraulic power units (not shown) for supplying the necessary hydraulic pressure to the various hydraulic actuators and motors used on the carriage 102 or the carriage support arms 238 and described above.

METHOD FOR CONSTRUCTING BRIDGES

In accordance with the invention, a method for constructing a girder bridge is hereinafter described, including use of the above described form placer and form stripper machines.

After the various pilings 12 and caps 14 have been secured at a particular bridge site, and the girders 16 have been laid in place, using any appropriate machinery and conventional method, the bridge deck 22 must be formed. The bridge deck 22 is comprised of concrete and includes reinforcement bars. The concrete for the bridge deck 22 is poured across the girders 16, on top of mounted forms 24 which have been clamped into place between two girders 16 (or secured to one edge girder 16 in the forming of the outside overhang on either side of the bridge). The forms 24 are heavy and must be handled using mechanical equipment.

The forms 24 are brought to the bridge site and positioned on a barge or truck. Depending on the height of the bridge being built, a separate conventional crane (not shown) may be used to lift several forms 24 to an area which is accessible to the hoists 56 of the form placer machine 18. It also may be possible for the hoists 56 of the form placer machine 18 to lift a form 24 directly from the truck or barge into place between two girders 16 in one quick step. In one embodiment of the invention, the hoists 56 have sufficient cable to hoist forms 24 a distance of about 100 feet. Of course, this distance may easy be lengthened to accommodate higher bridges. Once in place, the exact positioning of the form 24 is carried out by workmen, who then lock the form in place using known techniques.

The set up procedure for the form placer 18 is relatively simple. A length of rails 28 is secured to the exposed tops of two selected girders 16 using tie blocks 30. The entire form placer machine 18 may be lifted by crane into position onto the laid sections of rails 28. Once in place, the form placer 18 may be driven along the rails 28 by applying controlled hydraulic pressure to the hydraulic motor. When the form placer 18 rolls clear of a section of rail 28, the free rail section may be lifted using the corner cranes 58, as illustrated in FIG. 5.

The forms 24 may be lifted up between the open girders 16 and moved transversely across the bridge 10, as necessary using the hoists 56 moving along either of the two hoist supports 55.

After the forms 24 have been positioned by the form placer 18, appropriate reinforcement bars is positioned and concrete is poured over the girders 16, the forms 24 and the reinforcement bars. Once the concrete cures, the forms 24 may be removed from below the bridge 10.

The form stripper 20 may be simply driven onto the cured bridge deck 22 and positioned, using the steerable wheel assembly 126. Once the form stripper 20 is in position, the carriage support assembly 104 may be adjusted for the desired height so that the carriage 102 may provide effective access to the bridge girders 16. The two hydraulic actuators 232 may be powered to adjust the height of the support shafts 204 with respect to their guide sleeves 202. The locking pin may be then inserted into aligned locking openings 226, 224 to lock the carriage supporting assembly 104 at the desired position.

A hydraulic motor (not shown) is activated to swing each carriage support arm 238 from the stowed position to an operative position. The girder gripping assembly 246 is adjusted and secured to the lower portion of an appropriate girder 16. Once the girder is firmly gripped, the carriage 102 may be driven from its stowed position on the carriage holding frame 280 to an operative position along the tracks 272 between the two deployed parallel carriage support arms 238.

The carriage 102 is moved along the track 272 as desired. When a form 24 aligns with the carriage 102, the on board jack assembly 264 may be moved along the rails 262 until in position and then raised to meet the form 24. Once released from the girders 16, the form 24 may be lowered onto the platform 260 of the carriage 102. The carriage 102 is then moved along the track 272 to its stowed position, which resides out from under the girders 16. The hoists 132 may be moved along the support 130 into a lifting position over the stowed carriage 102. The form 24 on the carriage 102 may be lifted by the hoist 132 and moved along the support 130 to a loading area 134. As the forms 24 collect at the loading area 134, a crane or other suitable lifting machine, such as the hoisting equipment provided by the stripper machine, may move the removed forms 24 back onto a truck or barge to be advanced forward along the bridge 10 to the form placer 18 to be used once again.

To aid in balancing the form stripper machine 20, a ballast fluid, such as water may be pumped into the hollow pipe sections 108*a*, 108*d*, 112, 114 and 122. The weight of the water will counter-balance the entire machine 20, especially when the carriage support arms 238 are in their stowed position.

As the form stripper machine 20 travels along the bridge 10, and approaches an underlying cap or set of supporting pilings 12 (i.e., an obstruction), the carriage 102 must retreat back to its holding or stowed position, the girder gripping assembly 246 released, and the carriage support arms 238 retracted to its stowed position. In such a position, the form stripper machine 20 may easily pass the obstruction and quickly re-deploy the carriage to continue the form removal procedure.

What is claimed is:

1. Apparatus for removing forms from a girder position, located adjacent the girders of a bridge, said bridge including longitudinally spaced apart piers having pier caps extending a finite distance transversely, said pier caps supporting spaced girders, said girders supporting a roadbed, said apparatus comprising:

a frame structure;

a support attached to said frame structure and being positioned along a side of the bridge, and including a portion which is located below said bridge;

at least two arms pivotally attached to said support, said arms being pivotal between an operative position under at least one bridge girder and a stowed position generally parallel to said at least one girder, said arms in said operative position being generally parallel to each other and spaced apart a predetermined distance, said arms in said stowed position being located away from said bridge;

a carriage having a length which is at least equal to said predetermined distance, supported by and movably positioned between said arms;

means for moving said carriage along said length of said arms under said at least one girder;

means for supporting said carriage at an accessible location out from under said bridge when said arms are in said stowed position; and whereby forms may be removed from said girder position onto said carriage and transferred to said accessible location out from under said bridge.

2. The apparatus according to claim 1, wherein each of said at least two arms includes a length of track adapted to support and guide said carriage as said carriage moves therealong.

3. The apparatus according to claim 2, wherein said carriage includes rollers which are adapted to engage with and be guided by said track of each of said at least two arms.

4. The apparatus according to claim 1, wherein said support is vertically slidable so that said at least two arms may be raised and lowered with respect to said girders.

5. The apparatus according to claim 1, further comprising a drive motor for pivotally moving each of said at least two arms between said operative position and said stowed position.

6. The apparatus according to claim 1, further comprising means for moving said frame structure along said roadbed.

7. The apparatus according to claim 1, wherein each of said at least two arms has a predetermined length which is equal to about half of the width of said bridge.

8. The apparatus according to claim 7, wherein said predetermined distance of said carriage is at least equal to said predetermined length of each of said at least two arms.

9. The apparatus according to claim 3, wherein each of said at least two arms including a telescoping arm slidably extendable between a retracted position and a deployed position.

10. The apparatus according to claim 9, wherein said each of said at least two arms which said each respective telescoping arm in said deployed position having a length being approximately equal to the width of said bridge.

11. The apparatus according to claim 9, wherein each of said telescoping arm includes a track adapted to receive said wheels of said carriage to support and guide said carriage under the girders of the bridge.

12. The apparatus according to claim 1, wherein said support is attached to a support side of said frame structure.

13. The apparatus according to claim 12, wherein said frame structure further comprises counterweight located remote from said support side of said frame structure to counterbalance the weight of said support, said at least two arms and said carriage.

14. The apparatus according to claim 1, wherein said frame structure is made from pipe sections defining inner cavities.

15. The apparatus according to claim 14, wherein said frame structure further comprises a liquid counterweight located in said inner cavities.

* * * * *